United States Patent [19]

Ohseto

[11] Patent Number: 4,529,292

[45] Date of Patent: Jul. 16, 1985

[54] ELECTROPHOTOGRAPHIC REPRODUCTION PROCESS

[75] Inventor: Seiichi Ohseto, Numazu, Japan

[73] Assignee: Ricoh Co., Ltd., Japan

[21] Appl. No.: 454,077

[22] Filed: Dec. 28, 1982

[30] Foreign Application Priority Data

Dec. 28, 1981 [JP] Japan ..... 56-209875

[51] Int. Cl.[3] ..... G03G 21/00

[52] U.S. Cl. ..... 355/3 CH; 355/77; 430/31

[58] Field of Search ..... 355/3 CH, 77, 3 R, 15; 430/35, 97, 902, 31, 54

[56] References Cited

U.S. PATENT DOCUMENTS 4,095,980 6/1978 Satomi ..... 355/15 X 4,353,648 10/1982 Tanaka et al. ..... 430/97 X 4,396,273 8/1983 Matsuyama et al. ..... 430/35 X

*Primary Examiner*—R. L. Moses

*Attorney, Agent, or Firm*—Guy W. Shoup

[57] ABSTRACT

An electrophotographic reproduction process for forming an reproduced image of an original image with the use of a photosensitive member including a Se-As material as a photoconductive material. The process includes the steps of uniform charging, image exposure, developing, transferring, and discharging by irradiation of light. When the photosensitive member is subjected to repeated cycles of reproduction operation, the time period between the completion of discharging of the last preceding reproduction process and the initation of uniform charging of the next following reproduction process is set at a predetermined value which is 0.2 seconds or more in order to avoid the light fatigue effect of the photoconductive material.

12 Claims, 7 Drawing Figures

ELECTROPHOTOGRAPHIC REPRODUCTION PROCESS

BACKGROUND OF THE INVENTION

1. Field of the Invention

This invention relates to an electrophotographic reproduction process and in particular to such an electrophotographic reproduction process capable of forming a reproduced image of excellent quality without causing a forced fatigue to a photosensitive member even if the photosensitive member is used in repeated cycles.

2. Description of the Prior Art

In electrophotographic reproduction machines, the same photosensitive member including a photoconductive layer is repetitively used to form a reproduced image thereon, and while such a photosensitive member is subjected to process steps including uniform charging, image exposure, developing, transfer, cleaning and discharging, charges are trapped in the photosensitive member so that the surface potential of the photosensitive member fluctuates and the effectiveness of uniform charging becomes reduced. Consequently, the potential of the image area in effect decreases and thus the contrast between the light portion (background area) and the dark portion (image area) of an original image deteriorates. Furthermore, in the case where the next following cycle of reproduction operation is to be initiated after elapsing a relatively long resting period subsequent to the last operation, the trapped charges are gradually released during such a resting period so that the photosensitive member is temporarily restored to its original condition. As a result, reproduced images of high contrast may again be obtained only during the first few cycles and contrast again deteriorates as the reproduction cycle is repeated further thereby causing unstability in the quality of reproduced images.

The above-described phenomenon is often termed as light fatigue and it is well known that such a phenomenon is generally encountered in the case where use is made of a photosensitive member which is comprised of amorphous $As_2Se_3$ and the like. In order to cope with such a light fatigue phenomenon, one approach is to cause the photosensitive member forcibly fatigued to a sufficient level prior to the initiation of reproduction process thereby allowing to obtain a reproduced image of constant quality, as disclosed in the Japanese Patent Publication, No. 49-4337. Another approach is to carry out a dead cycle prior to the initiation of reproduction process in which the photosensitive member is subjected to blanket illumination by a light source for image exposure.

However, these prior art methods for obtaining reproduced images of constant quality by the application of forced fatigue suffer from various disadvantages. For example, the time period required to carry out such a forced fatigue step contributes to prolong the entire reproduction process thereby slowing down the process. And the prior art methods are rather difficult to implement and consumes a relatively large amount of power.

SUMMARY OF THE INVENTION

In accordance with the present invention, there is provided an electrophotographic reproduction process in which uniform charging constituting the first step of the next following reproduction process is carried out only after elapsing a predetermined time period upon completion of discharging by light irradiation constituting the final step of the last reproduction process. That is, the present invention has been developed on the finding that, in the case where discharging of a photosensitive member by light irradiation is to be carried out as the final step of a reproduction process, using the photosensitive member comprised of a material such as amorphous $As_2Se_3$ or the like, which has a relatively large fatigue effect by light irradiation, the equilibrium state is reached after elapsing a predetermined time period which corresponds to the transitional period during which the surface potential of the photosensitive member is gradually restored to the original condition upon completion of discharging by light irradiation.

It is therefore a primary object of the present invention to provide an improved electrophotographic reproduction process.

Another object of the present invention is to provide an electrophotographic reproduction process capable of producing reproduced images of constant quality even if the same photosensitive member is repetitively used to produce multiple reproductions.

A further object of the present invention is to provide an electrophotographic reproduction process which may be easily implemented by existing reproduction machines without requiring extensive modifications and yet allowing to obtain reproduced images of excellent quality at all times.

A still further object of the present invention is to provide an electrophotographic reproduction process capable of producing reproduced images of constant contrast without the application of forced fatigue to the photosensitive member used.

Other objects, advantages and novel features of the present invention will become apparent from the following detailed description of the invention when considered in conjunction with the accompanying drawings.

DESCRIPTION OF THE PREFERRED EMBODIMENTS

Figure 1:
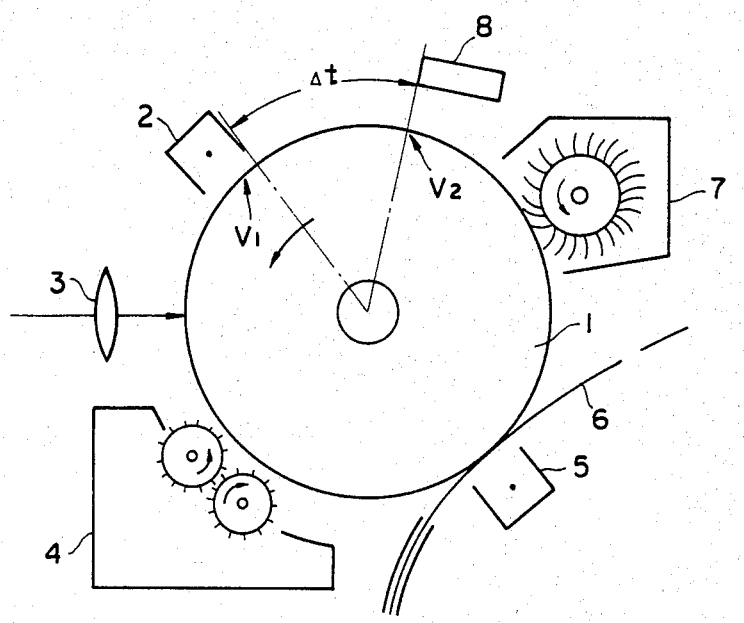
FIG. 1 is a schematic illustration showing a typical electrophotographic copying machine to which the present invention may be advantageously applied.
Figure 2:
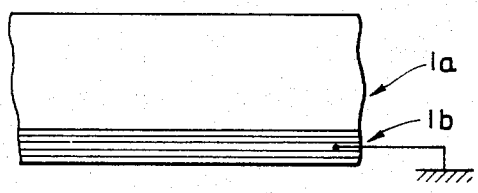
FIG. 2 is a schematic illustration showing on an enlarged scale a fragmentary, cross sectional view of the photosensitive member employed in the copying machine shown in FIG. 1.

Referring now to FIG. 1, there is illustrated a typical electrophotographic reproduction machine to which the present process may be advantageously applied as will be explained in detail hereinbelow. As shown, the copy machine includes a photosensitive drum 1 which is rotatably supported by a machine housing (not shown) and it is driven to rotate at constant speed in the direction indicated by the arrow. As is well known in the art, the photosensitive drum 1 is comprised of a photosensitive member fixedly attached to the peripheral surface of a drum. The photosensitive member, as shown in FIG. 2, includes a conductive support 1*b* which is grounded and a photoconductive layer 1*a* formed by a material of the Se-As family on the support 1*b*.

In the vicinity of and along the rotating direction of the drum 1 are disposed a uniform charging device 2, an image exposure device 3, a developing device 4, an image transfer device 5 and a cleaning device 7 in the order mentioned. Accordingly, as the drum 1 rotates, the peripheral surface of the drum 1 is first uniformly charged, for example, to the positive polarity by means of the corona charger 2, and then the uniform charges are subjected to exposure of an original image to be selectively dissipated to form an electrostatic latent image on the peripheral surface of the drum 1. Thus formed latent image is then developed by the developing device 4 in such a manner that negatively charged toner particles are applied to the latent image to form a visualized toner image. Then the toner image is transferred to a transfer medium 6 by means of the corona transfer device 5 which applies transfer coronas of the polarity opposite to that of the toner particles. Thereafter, the residual toner particles remaining on the peripheral surface of the drum 1 after the transfer step are removed by the cleaning device 7 which may be of the fur brush type as shown.

In accordance with the principle of the present invention, in the vicinity of the peripheral surface of the drum 1 and between the cleaning device 7 and the uniform charging device 2 is disposed a discharging device 8 for discharging the peripheral surface of the drum 1 by removing the charges remaining thereon after the cleaning step by uniform irradiation of light. Accordingly, the charges remaining on the peripheral surface of the drum 1 after the cleaning step are removed by the light emitted from the discharging device 8 and thus preparation is made to initiate the uniform charging step of the next following reproduction cycle. During the period from the step of uniform irradiation of light for removal of the remaining charges of the last reproduction process to the step of uniform charging of the next following reproduction process, the transitional phenomenon as will be described below takes place inside the photoconductive layer 1*a*.

That is, charges produced from electron-hole pairs by the incident light migrate either to the exposed surface or to the support 1*b* according to their polarities by going through the repeated process of being trapped and released on the way. In this instance, the density of free charges including those released from the traps temporarily increases beyond the level at the thermal equilibrium condition; however, as the time elapses, the charges produced migrate to the opposite surfaces and some of them are recombined and thus the thermal equilibrium condition is restored eventually. Under such a thermally nonequilibrium condition, the electrical characteristics of the photoconductive layer change reversibly due to the contribution of the free electrons to the conducting state of the photoconductive layer and the local field effects by the trapped charges.

In the case of a photoconductive layer including amorphous $As_2Se_3$, the ability to be sensitized or charged is temporarily reduced as one of the above-mentioned changes in electrical characteristics. Therefore, in particular, when use is made of a photosensitive member having a relatively large fatigue effect, the relaxation time period from the step of irradiation of light for discharging of the last preceding process to the step of uniform charging of the next following process is rather critical in stabilizing the electrical characteristics of the photosensitive member.

Figure 3:
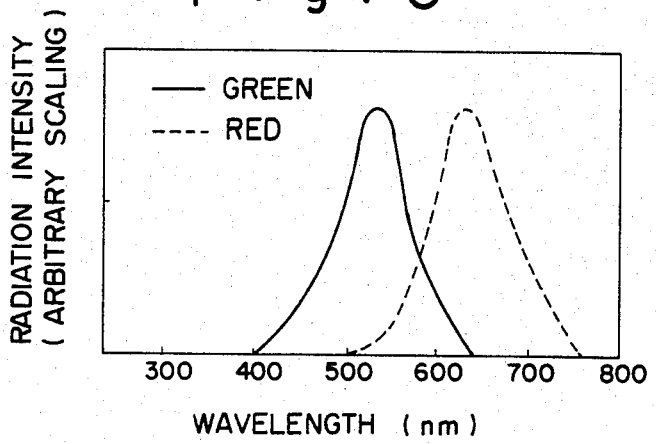
FIG. 3 is a graph showing spectral distribution of the light used for discharging the photosensitive member.

Now, a description will be made as to the experiments conducted by the present inventor in connection with the present invention. The photosensitive member used in the experiments had the following structure. The support of aluminum was prepared and a layer of amorphous Se-As was formed on the support to the thickness of 60 microns by vapor deposition. The amount of contents of As was 35.5% by weight, which may be regarded as equivalent to a photosensitive member of amorphous $As_2Se_3$ which is currently in practical use. The discharging device 8 was comprised of a pair of electroluminescent (hereinafter, also referred to as EL in an abbreviated form) panels: one of them emitting the red light having a peak wavelength of 630 nm and the other emitting the green light having a peak wavelength of 530 nm. The spectral distribution of each of these lights is indicated in FIG. 3. It is also to be noted that the reference character "$V_1$" shown in FIG. 1 indicates the surface potential (dark portion) of the photosensitive member immediately after the uniform charging step; on the other hand, "$V_2$" indicates the surface potential (background or light portion) of the photosensitive member after the discharging step by light irradiation.

Figure 4:
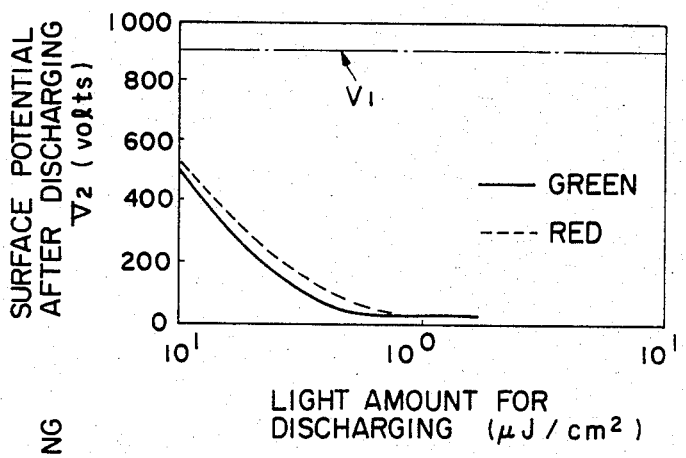
FIG. 4 is a graph showing the relation between the amount of light irradiated for discharging and the surface potential of the photosensitive member after such discharging.

In the first place, in order to investigate the required amount of light for the EL discharging device, the operating condition for the corona charger 2 was set such that the surface potential $V_1$ became 900 V under dark condition. Then the relation between the amount of irradiated light and the surface potential $V_2$ after the discharging step was examined for each of the red and green light and the results obtained are shown in FIG. 4. It is to be noted that in the above experiments the amount of light irradiation was changed by varying the input voltage to the EL device and its distance from the surface of the photosensitive member with the time period of light irradiation unchanged. As may be seen from FIG. 4, in the case of $V_1=900$ V, it can be said that the value of $6.0\times10^{-1}$ $\mu J/cm^2$ or more for either the red light or the green light is sufficient as the required light amount since the surface potential $V_2$ is in the order of the residual potential, i.e., 20 V or less, after the discharging step. With a slight margin included, the light amount was set at 1.0 $\mu J/cm^2$ in the present experiments.

Figure 5:
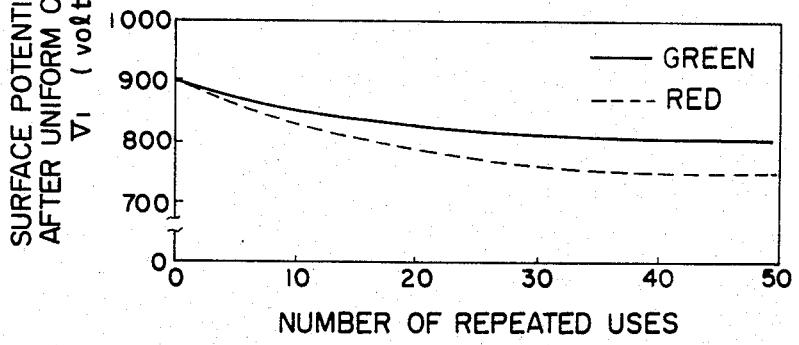
FIG. 5 is a graph showing the relation between the number of repeated cycles and the surface potential of the photosensitive member immediately after uniform charging.

Under the above-described conditions, the copy machine was operated repetitively and the variation of $V_1$ was measured, and its results are shown in FIG. 5. It is to be noted that in this investigation the time period from a point in time when a certain portion of the photosensitive member has just ceased to receive the light irradiation from the EL discharging device 8 to another point in time when that certain portion has just started to be uniformly charged by the corona charger 2 was set at 97 milliseconds. As is obvious from the graph of FIG. 5, the surface potential $V_1$ gradually decreases as the number of repeated cycles increases. Accordingly, it is believed that even if the discharging step is carried out with the above-described sufficient amount of light irradiation, the photoconductive layer immediately thereafter is still in the active state and it reaches the equilibrium condition only after elapsing a predetermined transitional time period. In other words, the gradual decrease in $V_1$ indicated in FIG. 5 appears to occur because the uniform charging step of the following process is carried out before the photosensitive member has reached the equilibrium state after the discharging step by light irradiation. That is, the time period of 97 milliseconds is considered to be too short.

Therefore, it is presumed that as long as the above-described time period is set sufficiently long in view of the transitional time period in which the photosensitive member reaches the equilibrium condition upon completion of the discharging step by light irradiation, a decrease in $V_1$ may be minimized to a practical level. The present invention has been developed based on the above-described findings and the present method is characterized in setting the time period between a point in time in which a portion of the photosensitive member has just finished receiving the light irradiation from the EL discharging device 8 and another point in time in which the portion of the photosensitive member has just started to be subjected to uniform charging which constitutes the initial step in the next following reproduction cycle to be a predetermined value or more. It is to be noted that such a time period should not be set too long because it will slow down the entire reproduction process. In the preferred embodiment, in the case where use is made of an amorphous As-Se family photosensitive member including 35–40% by weight of As, such a time period may be advantageously set at 0.2 seconds or more.

Figure 6A:
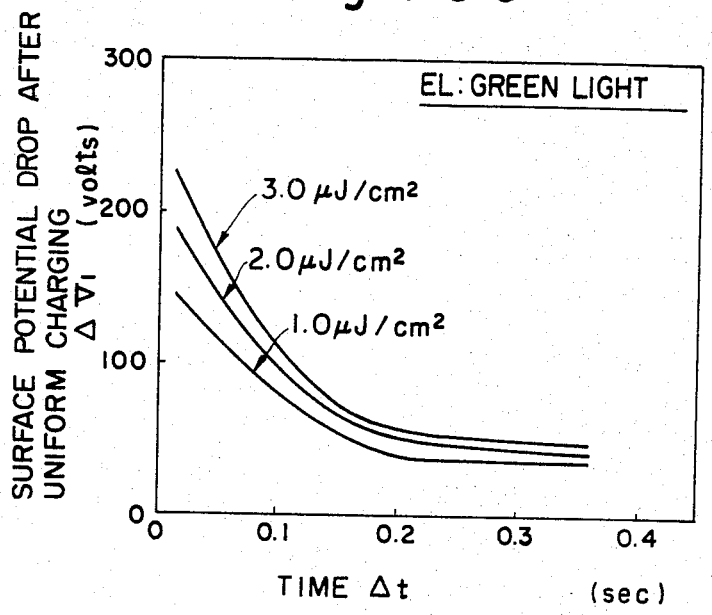
FIGS. 6*a* and 6*b* are graphs showing the decay characteristics of the surface potential of the photosensitive member after uniform charging with respect to time with the amount of irradiation taken as a parameter for green light and red light, respectively.
Figure 6B:
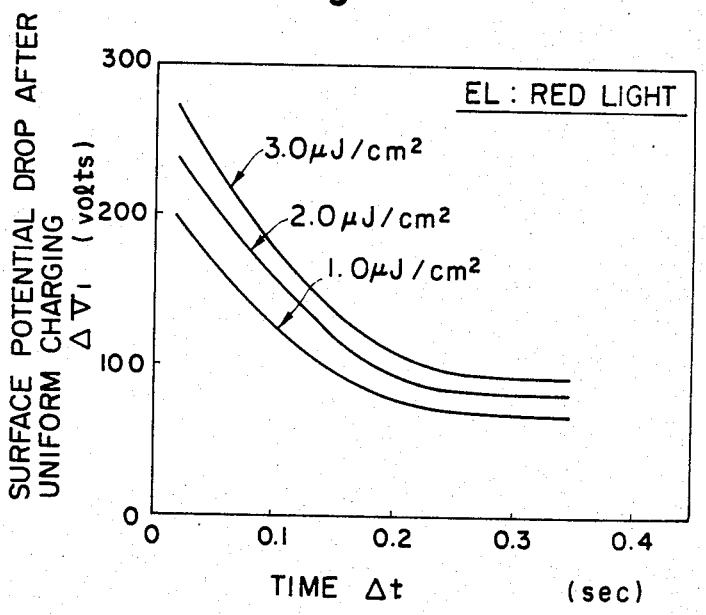

FIGS. 6*a* and 6*b* show the experimentally obtained potential drop of the surface potential $V_1$ after 50 repeated cycles as a function of the time period between completion of light irradiation for discharging and initiation of uniform charging with the amount of light irradiation taken as a parameter for the case of green light (FIG. 6*a*) and the case of red light (FIG. 6*b*). As a whole, it may be seen that the potential drop is larger for the green light than the red light and that the larger the amount of irradiated light, the larger the potential drop. However, dependency of the time period on the potential drop has a unique characteristic. That is, in the region where the time period is less than 0.2 seconds, the dependency is very high, but in the region where the time period is 0.2 seconds or more, the potential drop levels off to a constant value and the potential drop becomes independent of the time period. Importantly, such a unique characteistic does not differ depending upon the kind of the light source or the amount of light irradiation. Accordingly, the minimum time period to be reserved may be empirically determined to be 0.2 seconds. As a result, the potential drop and thus the contrast change in reproduced images may be limited to a minimum value by adjusting the operating conditions for the EL discharging device to satisfy the condition that the time period between the completion of the discharging step of the last preceding cycle and the initiation of the uniform charging step of the next following cycle is 0.2 seconds or more.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A process for forming a reproduced image of an original image with the use of a photosensitive member, said process being repetitively applicable to said photosensitive member and comprising the steps of:

uniformly charging said photosensitive member;

exposing said thus uniformly charged photosensitive member to a light image of said original image to form an electrostatic latent image corresponding to said original image on said photosensitive member;

developing said latent image with toner particles to convert said latent image into a visible toner image;

transferring said toner image to a transfer medium; and irradiating light to said photosensitive member to have said photosensitive member discharged for removal of residual charge thereby preparing said photosensitive member ready to be used in the next following reproduction cycle, wherein the improvement resides in that the step of uniformly charging for the next following reproduction process is initiated after the elapse of a predetermined time period determined by the light fatigue characteristic of said photosensitive member subsequent to completion of the step of irradiating light for removal of residual charge of the last preceding reproduction process.

2. A process of claim 1 further comprising the step of cleaning said photosensitive member for removing the toner particles remaining on said photosensitive member after the step of transferring.

3. A process of claim 1 wherein said photosensitive member includes a photoconductive material having a relatively strong light fatigue characteristic.

4. A process of claim 3 wherein said photoconductive material includes a Se-As material.

5. A process of claim 4 wherein said Se-As material includes amorphous $As_2Se_3$.

6. A process of claim 3 wherein said predetermined time period is set at 0.2 seconds or more.

7. A process of claim 6 wherein the amount of contents of As in said photosensitive member ranges from 35 to 40% by weight.

8. A process of claim 7 wherein the amount of contents of As is 35.5% by weight.

9. A process of claim 1 wherein said step of irradiating light for removal of residual charge includes irradiation of red light and green light.

10. A process of claim 9 wherein said green light has a peak wavelength of 530 nm and said red light has a peak wavelength of 630 nm.

11. A process of claim 9 wherein the amount of light irradiated for removal of residual charge is at least $6.0\times10^{-1}$ $\mu J/cm^2$.

12. A process of claim 11 wherein said photosensitive member is charged during said step of uniform charging such that the surface potential of said photosensitive member becomes approximately 900 V.

* * * * *